US006968670B2

(12) United States Patent
Wilson

(10) Patent No.: US 6,968,670 B2
(45) Date of Patent: Nov. 29, 2005

(54) METHOD OF FILLING A BAG AND AN APPARATUS FOR FILLING A BAG

(75) Inventor: Mathew J. Wilson, East Sussex (GB)

(73) Assignee: Webster Griffin Limited, Kent (GB)

( * ) Notice: Subject to any disclaimer, the term of this patent is extended or adjusted under 35 U.S.C. 154(b) by 0 days.

(21) Appl. No.: 10/417,576

(22) Filed: Apr. 17, 2003

(65) Prior Publication Data

US 2003/0217528 A1 Nov. 27, 2003

(30) Foreign Application Priority Data

Apr. 19, 2002 (GB) ..... 0209037

(51) Int. Cl.[7] ..... B65B 1/32

(52) U.S. Cl. ..... 53/502; 53/525

(58) Field of Search ..... 53/437, 525, 502, 53/52, 284.7, 393

(56) References Cited

U.S. PATENT DOCUMENTS 1,777,227 A 9/1930 Roth

FOREIGN PATENT DOCUMENTS

GB 2034904 6/1980

*Primary Examiner*—John Paradiso
(74) *Attorney, Agent, or Firm*—Fay, Sharpe, Fagan, Minnich & McKee, LLP

(57) ABSTRACT

A method and apparatus for filling a flexible intermediate bulk container bag is disclosed wherein the bag is suspended clear of an underlying platform by a lift (9) urged upwards by a counterweight (11) so that during filling the bag "B" the bag falls to the underlying platform to prepare a stable base. There is also disclosed a telescopic spout (8) for delivering fill to the bag (B) and a spout closure (24) for preventing spillage of fill from the spout after filling. Hooks (10) for suspending the bag from the lift may be articulated and overlooking to allow for automation of the bag release after filling. A base (1) and tower frame (2) of the apparatus can be pivotally connected to enable the apparatus height to be reduced for transport.

25 Claims, 7 Drawing Sheets

METHOD OF FILLING A BAG AND AN APPARATUS FOR FILLING A BAG

The present invention is concerned with filling a bag, that is to say the process of filling a large flexible bag with a fill. The invention is primarily concerned with filling bags of the type known as Flexible Intermediate Bulk Containers (FIBC) and sometimes known as supersacks or big bags which when full weigh of the order between $2\times10^2$ kg and $2\times10^3$ kg. The bags may have a volume of the order between $2.50\times10^2$ liters and $2.5\times10^3$ liters. The bag size is most commonly quoted as height (or length when laid flat) and is usually of between 0.4 m and 2.5 m. Fill is commonly a particulate material, although it is conceivable that the invention may apply to liquids.

In filling a bag in a commercial environment various attributes are desired from the method and apparatus. In particular, it is desirable that the fill is closely packed into the bag, especially into the base of the bag. It is desirable that the filled bag have a well formed base to minimise any inclination to topple. This is particularly important where large bags are concerned. It is desirable that the method and apparatus be readily adaptable to fill a large range of bag sizes and of handling a wide variety of fill types. In this context fill types may included grain sizes from the order of 1 $\mu$m (fine powder) to 50 mm (coarse granules).

It is very desirable that the size of the fill charge is accurately measured, and that there is minimal spillage from the apparatus. It is further desirable that the filled bags can be readily transported from the apparatus with minimal risk of spillage. It is also desirable that the throughput, of the method and apparatus is high.

In an effort to improve on at least one or more of the aforementioned characteristics of the known prior art apparatus the present invention provides: a method for filling a bag comprising the steps of: applying a counter load to a lift so that the lift is urged up, suspending a bag from a lift so that the bag hangs clear of a platform underlying the bag, and subsequently, discharging fill into the bag until the weight of the bag and fill exceeds the counter load such that the bag falls to the underlying platform.

For the convenient implementation of the method the present invention further provides a bag filling apparatus comprising: an upright structure supporting a filling spout and a lift, said lift mounted for vertical displacement and adapted to suspend a bag, and a counter load device coupled to urge the lift up and capable of lifting the lift and a suspended bag clear of an underlying platform.

In order to implement the method above a second aspect of the invention provides a bag filling apparatus comprising: a lift mounted for vertical displacement and adapted to suspend a bag, and a counter load device coupled to urge the lift up, whereby a bag can be suspended clear of an underlying platform, so that a predetermined weight of fill in a bag will overcome the counterload and cause a filled bag to fall to the platform and weight sensors arranged to sense the weight of the apparatus, bag and fill.

The apparatus may comprise an upright structure having a base supporting, a vertical tower frame, and a jib extending horizontally from the tower frame to support the filling spout, and wherein the lift is slidably engaged in a track provided on the tower frame to extend horizontally beneath the filling spout. The counter load device may conveniently be provided by a weight coupled to the lift by means of an elongate flexible linkage such as a belt or chain bent over a pulley at the top of the upright structure. A motor such as a pneumatic ram also serves to raise the weight and hence lower the lift to a height convenient for manually hanging the bag or disconnecting the bag after filling. By suspending the counter weight from the upright structure in this way, the available height of travel for the weight and hence the lift can be maximised allowing a very large range of bag sizes to be filled by the apparatus.

During filling the bag is initially clear of the platform so that fill pours unobstructed into the bottom of the bag. The size of the counter load is selected according to experience, the size of the bag and the nature of the fill so that when the bag is partially full, it falls to the platform. This causes the fill to fill the bag in a manner which forms a good stable base. This can be further enhanced by providing a vibration table in the apparatus which is actuated when the bag lands on the platform. Vibration will ordinarily only be applied intermittently or after filling the bag else it may affect the sensed weight of the bag. The weight of fill in the bag may conveniently be sensed by load sensors mounted in the upright structure whereby they respond to the weight of the whole apparatus. The sensors can be set on tare to allow for the weight of the apparatus and bag before the fill begins.

On installation the spout, which has a fill receiving port, is coupled to a dosing device, such as a screw feed, which is arranged in communication with a control unit of the apparatus. The other, lower, discharge end of the spout is provided with a discharge port adapted to fit into the open top of a bag. In particular FIBC's are conveniently provided with a neck with which the discharge port is connected. The discharge port is preferably secured to the neck by a collar. The collar may be either of; an inflatable collar which surrounds the discharge port and is inflated in the neck of the bag after the neck of the bag is sleeved over the port, or a clamping collar which closes around the outside of the neck after it is sleeved onto the discharge port.

To enable the filling spout to engage with the bag opening at any lift height the discharge port of the filling spout must move with the lift. To this end the spout may be made extensible, preferably this achieved by making the filling spout telescopic with the discharge port end coupled to the lift and the receiving end mounted on the jib. If the spout is telescopic the sides can be smooth and rigid and so relatively immune to fouling.

To relieve the air pressure in the bag as the fill is discharged into it the filling spout may include a vent passage. To maximise the control of the discharge from the spout a closure is provided at the discharge port of the spout. Preferably the closure is a butterfly gate. The method of the invention preferably includes the step of controlling the closure so that it is coordinated with the dosing device which delivers the fill to the receiving port whereby, when the dosing device is stopped in response to the weight of the fill in the bag reaching a target weight the closure closes a period of time later selected to permit fill falling through the spout to fall into the bag. This is useful because, particularly where the fill is a fine particulate such as a die, small quantities will stick temporarily to the inside of the spout and are then disturbed as the bag is removed contaminating the environment or the bag.

Suspension of the bag may be achieved by a number of means including grips to grip the bag or simple hooks to engage the loops ordinarily provided for the purpose on an FIBC bag, however, it is preferred that the adaptation of the lift to suspend the bag is by means of articulated hooks capable of engaging the loops formed on the bag. The articulation of each hook is such as to form an overlooking mechanism whereby the weight of the bag urges the hook to retain a hooked configuration. When free of the weight of the bag each hook can readily be articulated to an open configuration. It may be convenient to provide rams to articulate the hooks. It will be appreciated that an important advantage of the method and apparatus is that upward tension is applied to the fabric of the bag at all times during the filling step so that the bag is encouraged to fill uniformly from bottom to top.

The apparatus and method can readily be automated. In this event a control unit (e.g. a microprocessor) may be arranged to be responsive to signals from sensors arranged to detect the height of the lift and the load sensors and to control the actuation of the motor (pneumatic ram), the fill spout closure, the collar, the vibration table, articulated hooks and even a conveyor such as a belt or roller table which may be provided to transport the filled bag from the machine. Thus the control unit first sets the lift to a height convenient to suspend the bag from the lift by actuating the motor to raise the counter load. When the bag neck has been sleeved onto the discharge port the collar is secured. The articulated hooks are set to the hooking condition and hooked onto the bag loops. The lift is raised to a height preset to bring the bag clear of the platform by operating a motor to release the counter load. When the lift reaches a sufficient height the closure of the fill spout is opened and the dosing device actuated so that fill falls into the bag. As the weight of the bag increases it eventually overcomes the counter load and falls to the platform. When the weight sensed by the load sensors reaches a preset weight which may be determined by the control unit, the control unit responds by stopping the dosing device and actuating the closure as described above.

The next step in processing the bag and fill is to close the bag. This can be achieved by twisting the top of the neck of the bag. To this end a rotor is provided which is arranged to rotate the neck of the bag relative to a body of the bag. This could be achieved by rotating the platform, however, it is preferably to mount the collar, particularly the inflatable collar on a motorised rotor, so that the neck can be rotated. The neck may then be manually or automatically tied off before the bag collar is disengaged from the spout.

Once the bag neck is closed the bag can be released from suspension either by releasing the articulated hooks from the hooking condition or by raising the counter load so that the upward tension applied by the hooks is relieved.

If provided a conveyor such as a belt or roller table may then be operated to convey the filled bag from the apparatus.

According to a third aspect of the present invention there is provided a bag filling apparatus comprising a filling spout having a discharge port and a closure provided at the discharge port capable of opening and closing the port.

According to a fourth aspect of the present invention there is provided a bag filling apparatus comprising a lift from which a bag can be suspended and a rotor capable of rotating the top of the bag relative to the body of the bag to twist it closed.

According to a fifth aspect of the present invention there is provided a bag filling apparatus comprising a lift provided with an articulated hook whereby a bag can be suspended from the lift clear of the ground, said hook articulating from a first bag hooking condition where the weight of a bag suspended from the hook acts on an overlooking mechanism to prevent the release of the bag from the hook and a release condition at which the bag can be freed from the hook.

It is preferable that the tower frame, the base and the jib are configured to provide a cantilever structure so that access to the apparatus from the front and sides is readily available. This enhances the versatility of the apparatus in terms of where it can be installed and particularly makes access via a conveyor easy. It also provides for a further aspect of the invention whereby the tower frame is secured to the base via a pivot which permits the tower frame to be inclined from the vertical for transport. To appreciate this aspect of the invention fully it should be realised that the apparatus is typically 3.8 m or more in height when installed and is modular such that in some installations a conveyor and/or vibration table are optional features according to the requirements of a customer. If the apparatus exceeds 2.8 m it cannot be transported intact and must be assembled a piece at a time on site. This is disadvantageous in terms of labour and time and has implications to the degree of factory testing that can be implemented before transport to the site for commissioning. By mounting the tower frame pivotally the apparatus can be factory assembled complete with all required optional components and tested extensively before subsequently inclining the tower frame and bracing the frame, jib and lift. In this transport condition the apparatus can be loaded into a conventional container and transported to the installation site. The step of inclination and raising the tower frame can readily be achieved by a fork lift truck or crane such as is likely to be used to transport the apparatus on site.

A bag filling method and an apparatus for filling a bag embodying the present invention will now be described by way of example only with reference to the accompanying figures, in which.

Figure 1A:
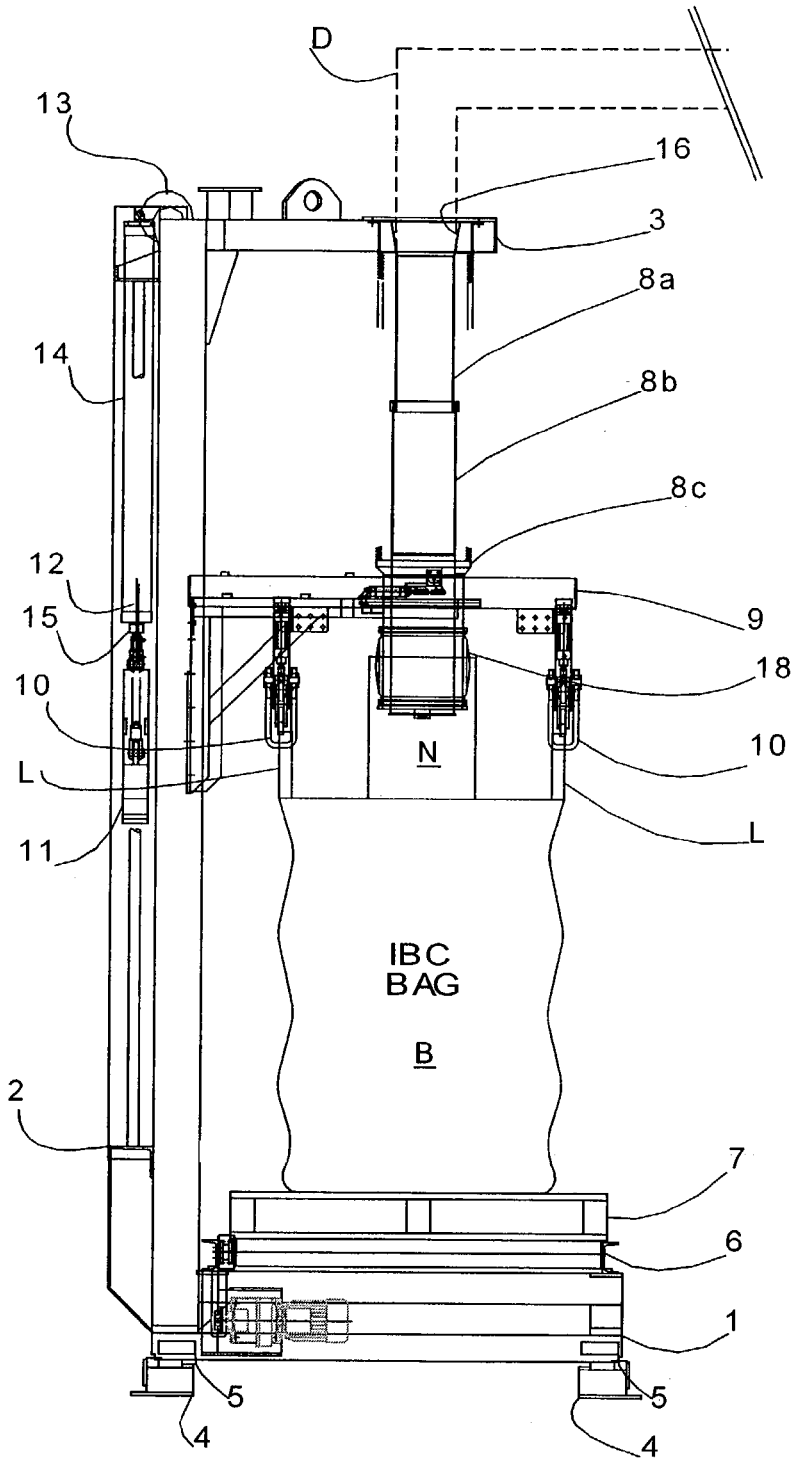
FIGS. 1A to 1D illustrate in part sectional elevation the sequence of steps involved in the method of filling a bag and an apparatus therefore.
Figure 1B:
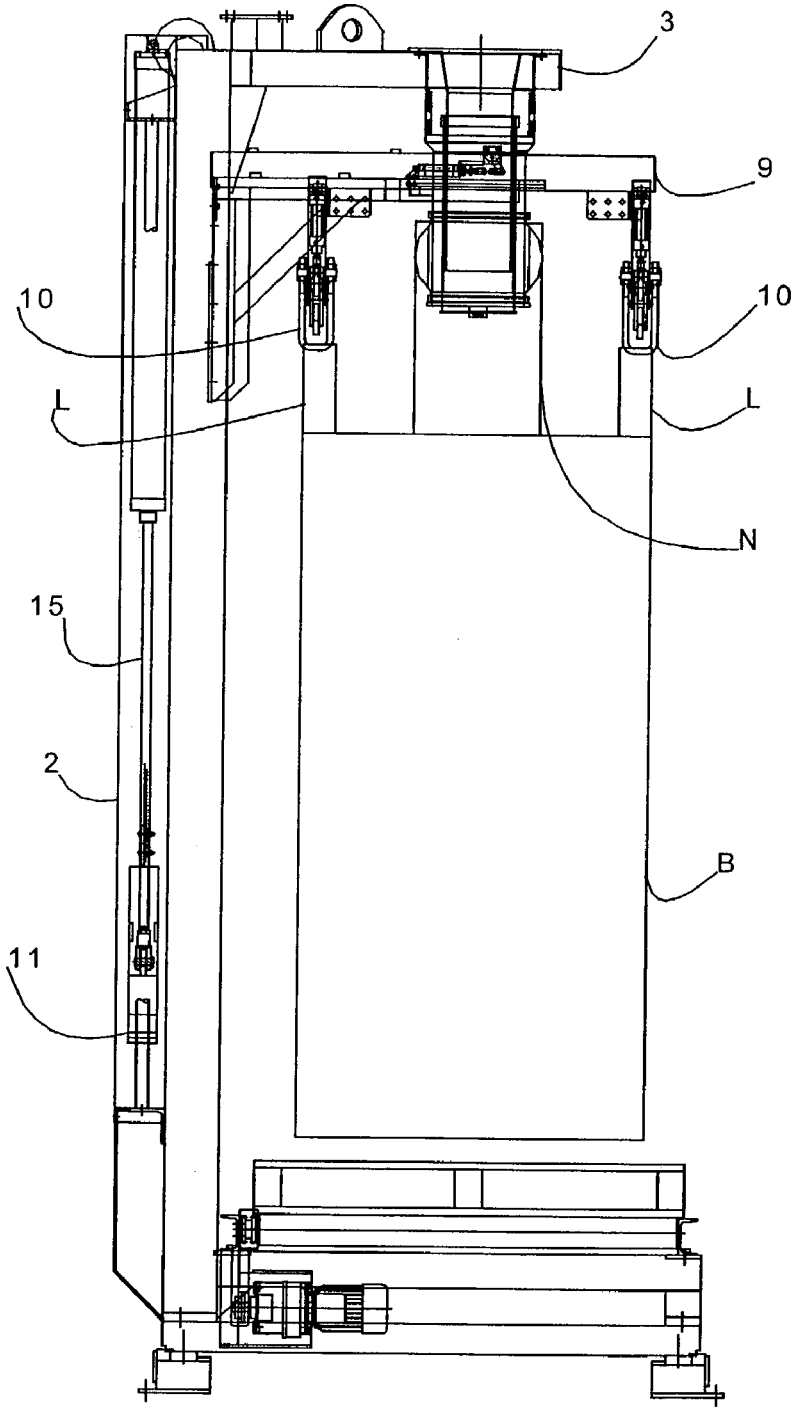
Figure 1C:
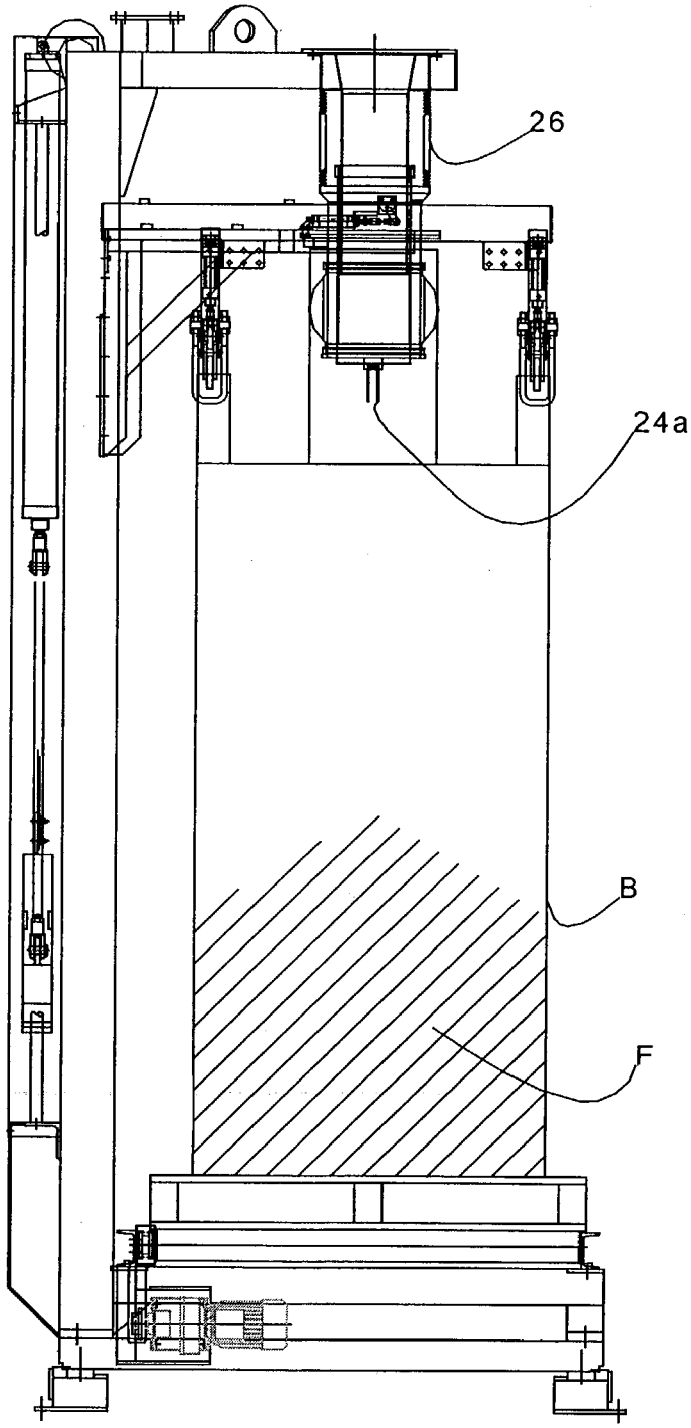
Figure 1D:
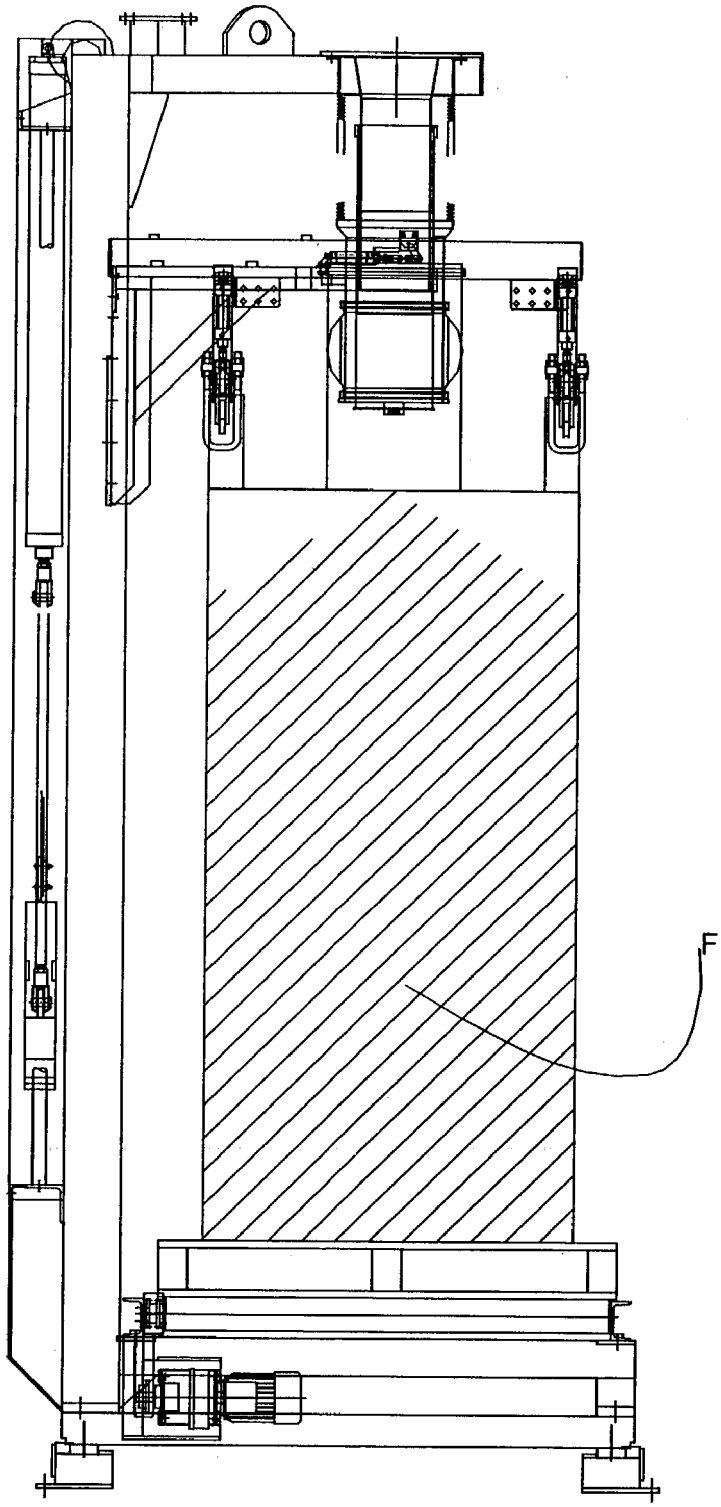

The figures show a bag filling apparatus having an upright structure comprising a base 1, a vertical tower frame 2 and a jib 3. The base 1 extends horizontally and incorporates ground engaging feet 4. Load cells 5 are provided in the base to sense the weight of the apparatus, bag and fill. A roller conveyor 6 is supported on the base 1 and a platform is provided by a pallet 7 located to receive a bag. In some apparatus the platform may be provided directly by the roller conveyor or a belt conveyor, or the conveyor may be omitted altogether. In some apparatus a vibration table may be provided beneath the platform.

The tower frame 2 rises from a back side of the base 1 to its top at a height of approximately 3.8 m. The jib 8 extends horizontally from the tower frame 2 to overly the base 2. The jib supports a spout 8 to depend over the centre of the palette 7.

A lift 9 is provided by a frame extending horizontally from a track (not shown) provided in the tower frame 2 so that it can readily move vertically. The lift is adapted by the provision of four articulated hooks 10 to suspend a bag "B". Each hook 10 is located at the corners of a square overlying the platform 1 with the spout 8 lyingbetween the hooks 10.

A counter load is provided by a pair of weights 11 (of which only one is shown) which are guided by guide rods. An elongate flexible linkage is provided by a toothed belt 12 which is guided up the tower frame 2 and over a guide provided by a pulley 13 to be connected with the lift 9. Thus the weights 11 provide a force which urges the lift 9 up. To allow the height of the lift to be controlled during the method a motor is provided by a pneumatic ram 14. When air is delivered to the ram cylinder a connecting rod 15 engages the weights 11 and draws them up to a position such as that shown in FIG. 1A.

The top of the spout 8 has a receiving port 16 which is mounted on the jib 3 and upon installation will couple with a dosing device "D" adapted to convey the fill to the apparatus. The dosing device will have some means such as a screw conveyor whereby the delivery of the fill "F" can be stopped and started. The nature of the device will depend upon the nature of the fill. In an automated installation the dosing device may be controlled from a control unit of the apparatus.

The spout 8 is telescopic and formed in this instance of three sections 8*a,* 8*b* and 8*c*.

The bag is an FIBC type bag provided with a neck "N" or having a liner with a neck "N" as is known.

Figure 3C:
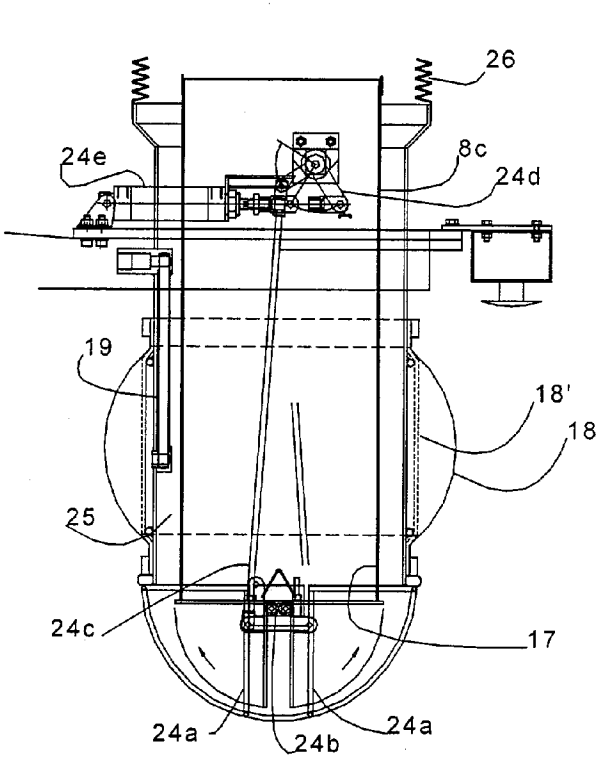
FIG. 3C is an enlarged sectional view of the spout.
Figure 3B:
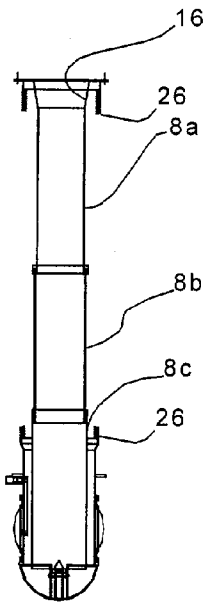
FIG. 3B is a part sectional view through the spout in an extended condition.
Figure 3A:
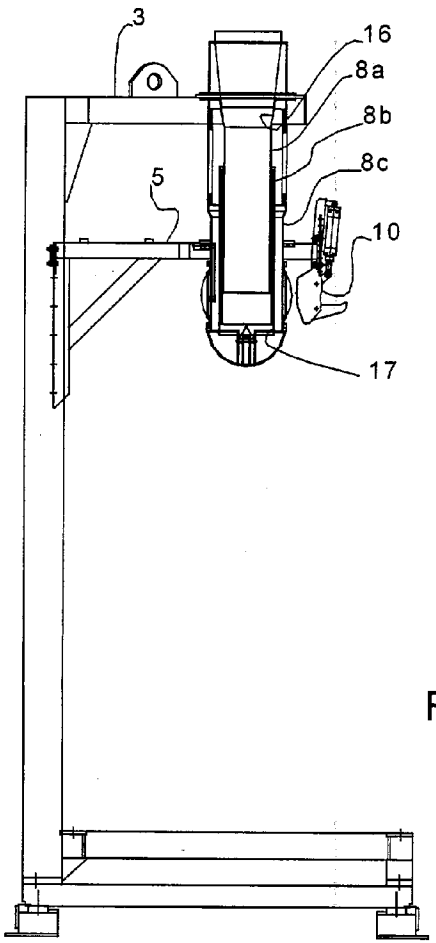
FIG. 3A is a part sectional elevation through a telescopic spout, mounted upon the upright structure and in a retracted condition.

The spout section 8*c* is supported by the lift 9 and provides a discharge port 17 sized to be sleeved into the neck "N" as can best be seen in FIG. 3. To secure the spout into the neck "N" and to prevent leakage of the fill an expansible collar is provided by means of an inflatable ring 18 fastened around the discharge port 17. At 18' the ring is shown deflated. Compressed air can be delivered to the inflatable ring 18 via a pipe 19 to inflate the ring to the condition shown at 18.

Figure 2:
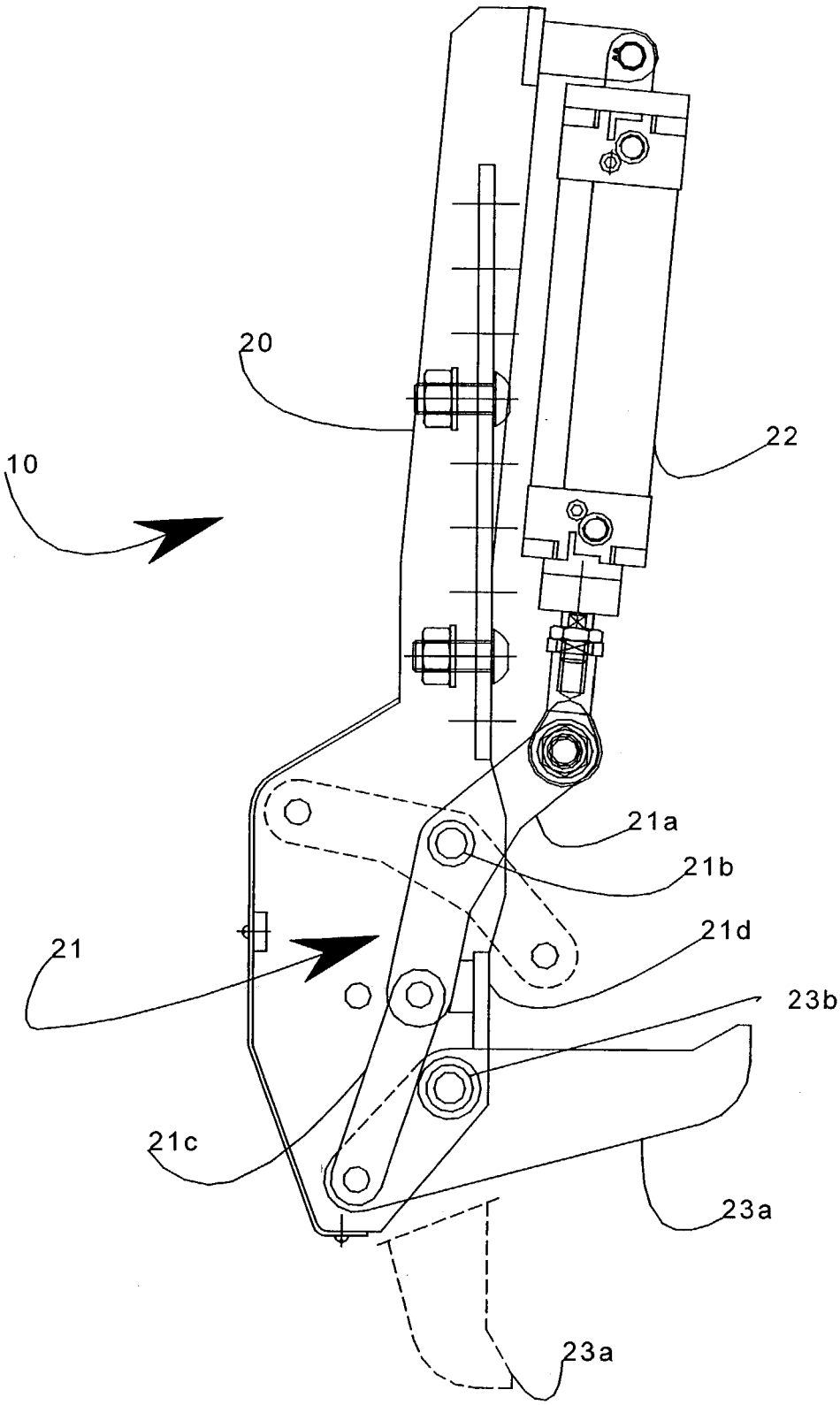
FIG. 2 illustrates in side elevation an articulated bag loop hook.

In operation the bag filling method starts with the lift in a lowered position as shown in FIG. 1A which allows an operator to conveniently attach a bag "B" to the lift by engaging the hook loops "L" provided on the sack "B" one each with each of the articulated hooks 10. At this time each articulated hook 10 is in a loop engaging condition shown in solid in FIG. 2. Each hook consists of a hook body 20 which supports an overlooking mechanism 21, a pneumatic actuator 22 capable of actuating the overlooking mechanism 21 and a hook part 23*a*. The hook part 23*a* is mounted on a pivot 23*b* to pivot between a horizontal loop engaging position as shown in solid and a vertical loop disengaging position as shown in broken line. The overlooking mechanism 21 consists of a crank arm 21*a* mounted on a crank pivot 21*b* and having one end engaged with the actuator 22. The other end of the arm is pivotally engaged with a link 21*c* linking the crank arm to the hook part 23*a*. A stop 21*d* is mounted on the hook body 20 to constrain displacement of the link and crank in one direction. When the hook part 23*a* is weighted the link and crank are urged against the stop 21*d* progressively more forcefully as the weight increases. When it is desired to release the hook 10 the actuator displaces one end of the crank 21*a* to overcome the overlock so that the hook part 23*a* rotates to the release position.

The neck of the bag is secured in place by sleeving it over the inflatable ring 18 and inflating the ring 18. At this stage the control unit relieves the pressure in the pneumatic ram 14 so that the lift is pulled up by the weights 11. It may here be noted that the size of the weights may be adjusted to accommodate a particular bag size and fill type.

With the bag raised to the position shown in FIG. 2B there is a clearance between the bottom of the bag and the platform 7. At this step the control unit will actuate the dosing device "D" and open a closure provided on the discharge port 17. The closure is provided by a butterfly valve assembly. The butterfly valve assembly 24 consisting of a pair of semicircular butterfly valves 24*a* mounted one each on a pair of parallel pivot pins 24*b* which extend diametrically across the discharge port 17. Each valve 24*a* is connected via a connecting rod 24*c* which extends up the outside of the section 8*c* to an arm 24*d* of a crank. The other arm of the crank connects to an actuator 24*e* which may conveniently be a pneumatic actuator.

Where a liner is used within the bag "B" the apparatus and method may deliver compressed air into the bag via the discharge port to inflate the liner to the walls of the bag. Compressed air may continue to be delivered to through the discharge port 17 to encourage the fill flow into the bag. To provide for the exhaust air an exhaust duct 25 is provided concentrically around the spout section 8*c* and communicates with an exhaust vent (not shown) in the receiving port 16 via flexible extensible ducting 26 which extends up and around the spout to the jib 3. The exhaust duct may communicate with air filtering apparatus.

As the bag fills with fill its weight overcomes the weights 11 of the counter load and it falls to the pallet 7. At this stage vibration may be applied to the bag by vibrating the pallet 7. In order to ensure the weighing accuracy the dosing device may be stopped temporarily during the vibration step. Filling then proceeds until the control unit senses from the load sensors that a target weight has been reached. At this stage the dosage device "D" is stopped, automatically by the control unit. After a short period of time sufficient to allow any fill falling through the spout to pass the discharge port 17, the butterfly valve 24 is closed, in response to signals from the control unit.

The inflatable ring 18 is mounted on bearings (not shown) to provide a rotor which is coupled to a rotor motor (not shown) whereby it can be rotated automatically in response to control signals from the control unit. Thus when the bag target weight is achieved the bag neck is closed by rotating the inflated ring 18 and so twisting up the neck of the bag. The twisted neck can then be secured by tying off either manually or preferably automatically.

A further possible step in the method involves the continued operation of the bag venting system by the evacuation of air from the bag after the fill has been stopped by applying a vacuum to the exhaust passage 25. This allows any air suspended fill to be discharged reducing the risk of environmental contamination. It may also evacuate air from the bag encouraging closer packing of some fills. This step also facillitates the step of twisting off the neck of the bag.

The bag may be released automatically by arranging the control unit to actuate the pneumatic actuators 22 to release the articulated hooks possibly in response to twisting up the neck and tying off. The control unit may then automatically operate the roller conveyor to transport the filled and sealed bag away from the apparatus. It will be noted that the cantilever arrangement of the base, tower frame, jib and lift make access to the apparatus particularly easy.

If articulated hooks are not fitted or to prevent any or over rapid rise of the lift, pressure may be applied to the pneumatic ram 14 to constrain or prevent the lift rising for example if it is desired to immediately fill another bag.

Figure 4:
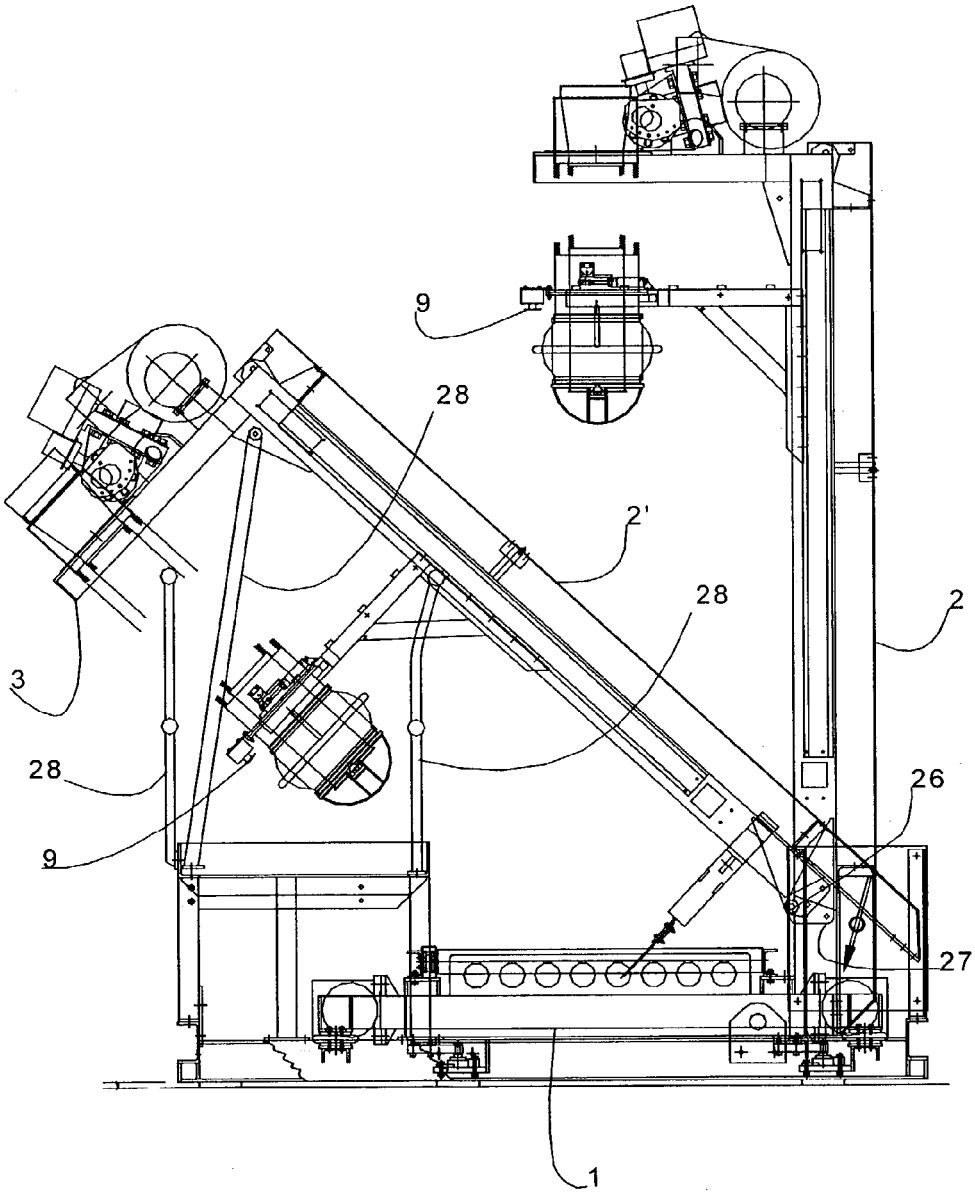
FIG. 4 is a side elevation illustrating the apparatus in a transport condition and a ready for use condition.

FIG. 4 shows the apparatus adapted for transport and easy installation by the provision of a frame pivot 26 between the bottom of the tower frame 2 and the base 1. This allows the tower frame 2 to be inclined towards the horizontal at an angle of between 30 and 55 degrees (for example) so that the height of the assembled apparatus can be reduced to a height compatible with conventional means of transport, e.g., 2.8 m. Thus the apparatus can be assembled together with any optional components, such as a vibration table or roller table ordered by the customer and factory tested. A bracket 27 associated with the pivot 26 is then unbolted to allow the tower frame to be pivoted as shown and braces 28 are secured between an operator platform and the tower frame and jib to secure the apparatus for transport. The whole apparatus can then be moved as a single piece to its commissioning site where it may be mounted directly onto prepared foundations beneath a pre-installed dosing device and using a crane or fork lift truck, the tower frame can be raised back to its operating position and secured via the bracket 27.

What is claimed is:

1. A bag filling apparatus comprising:

a lift mounted for vertical displacement and adapted to suspend a bag, and a counter load device coupled to urge the lift up, whereby a bag can be suspended clear of an underlying platform, so that a predetermined weight of fill in a bag will overcome the counter load and cause the filled bag to fall to the platform and load sensors arranged to sense the combined weight of the apparatus and bag and fill for determining a net weight of the fill.

2. Apparatus according to claim 1 wherein the counter load device is provided by a weight, depending from an upright structure.

3. Apparatus according to claim 2 wherein the weight is coupled to the lift by an elongate flexible linkage.

4. Apparatus according to claim 2 wherein a motor is provided to raise the weight and hence to lower the lift.

5. Apparatus according to claim 4 wherein the motor is a longitudinally extendable pneumatic ram.

6. Apparatus according to claim 1 comprising an upright structure which includes:

a base supporting, a vertical tower frame, and a jib extending horizontally from the tower frame to support a filling spout, and wherein the lift is guided by a track provided on the tower frame to extend horizontally beneath the filling spout.

7. Apparatus according to claim 6 wherein the flexible linkage is coupled to the lift, passes over a guide provided on the tower frame and depends from the guide to suspend the weight.

8. Apparatus according to claim 6 wherein the filling spout is telescopic with an extensible discharge port end coupled to the lift.

9. Apparatus according to claim 8 wherein the extensible discharge port end of the filling spout has a collar whereby it can be secured into the open top of a bag.

10. Apparatus according to claim 6 wherein the filling spout includes a vent passage to permit the discharge of air from the bag as it is filled.

11. Apparatus according to claim 6 wherein a discharge port of the filling spout is provided with a closure means.

12. Apparatus according to claim 11 wherein the closure means is a butterfly gate.

13. Apparatus according to claim 6 wherein a rotor is provided whereby the bag and the spout are relatively rotatable to twist and hence close the top of the bag.

14. Apparatus according to claim 13 wherein the collar is mounted on the rotor.

15. Apparatus according to claim 6 wherein the tower frame is coupled to the base via a pivot and bracket assembly whereby the tower frame can be inclined relative to the base and to reduce its height for transport.

16. Apparatus according to claim 1 wherein the bag is suspended from the lift by means of articulated bag loop hooks which are overlocking to prevent the accidental release of the hooks when weighted by a bag.

17. Apparatus according to claim 16 wherein rams are provided to enable the release of the loop hooks.

18. Apparatus according to claim 1 wherein the weight of the apparatus, bag and fill is sensed by load sensors provided in feet supporting the apparatus.

19. Apparatus according to claim 18 having a control unit arranged to compare the weight of the bag and fill with a predetermined weight and to control a dosing unit delivering the fill to a receiving port of the spout so that the delivery of fill from the dosing unit can be stopped when the weight of the bag and fill reaches a predetermined value.

20. Apparatus according to claim 19 wherein the control unit is arranged to:

sense when the bag has fallen to the platform and to stop the dosing device and to raise and actuate a vibration table to pack the fill.

21. Apparatus according to claim 19 wherein said control unit is arranged to close the closure in the spout a predetermined period after stopping of the dosing unit to allow any fill passing through the spout to discharge.

22. Apparatus according to claim 19 wherein said control unit is arranged to cause the rotor to rotate the spout relative to the bag in response to the closure closing.

23. Apparatus according to claim 19 wherein the control unit is arranged to actuate a conveyor to convey the filled bag from the platform.

24. A bag filling apparatus comprising:

a lift mounted for vertical displacement and adapted to suspend a bag, and a counter load device coupled to urge the lift up, whereby a bag can be suspended clear of an underlying platform, so that a predetermined weight of fill in a bag will overcome the counter load and cause the filled bag to fall to the platform and load sensors arranged to sense the combined weight of the apparatus and bag and fill;

an upright structure including a base supporting a vertical tower frame, and a jib extending horizontally from the tower frame to support a filling spout;

the lift is guided by a track provided on the tower frame to extend horizontally beneath the filling spout;

the filling spout is telescopic with an extensible discharge port end coupled to the lift; and, the extensible discharge port end of the filling spout has a collar whereby it can be secured into the open top of a bag, the collar includes an inflatable ring for expansion thereof.

25. A bag filling apparatus comprising:

a lift mounted for vertical displacement and adapted to suspend a bag;

a counter load device coupled to urge the lift up, whereby a bag can be suspended clear of an underlying platform, so that a predetermined weight of fill in a bag will overcome the counter load and cause the filled bag to fall to the platform; and, load sensors arranged to sense an initial combined weight of the apparatus and the bag for comparison with a subsequent combined weight of the apparatus, the bag, and the fill.

* * * * *